US005549534A

United States Patent [19]

Parviainen

[11] Patent Number: 5,549,534

[45] Date of Patent: Aug. 27, 1996

[54] SPINE REHABILITATION APPARATUS

[76] Inventor: Arno Parviainen, Karitie 9, SF-01530 Vantaa, Finland

[21] Appl. No.: 172,567

[22] Filed: Dec. 22, 1993

Related U.S. Application Data

[63] Continuation-in-part of Ser. No. 53,530, Apr. 27, 1993, abandoned, which is a continuation of Ser. No. 792,021, Nov. 13, 1991, abandoned, which is a continuation-in-part of Ser. No. 476,160, Feb. 7, 1990, abandoned.

[30] Foreign Application Priority Data

Feb. 7, 1989 [FI] Finland ..... 890581

[51] Int. Cl.[6] ..... A63B 23/02

[52] U.S. Cl. ..... 482/137; 482/134; 482/142; 482/907; 601/24

[58] Field of Search ..... 482/92–94, 98–100, 482/104, 110, 111, 114, 118, 121, 123, 133, 134–140, 142, 148, 908, 907; 601/24; 297/284.4, 452.3–452.36; 606/237, 240

[56] References Cited

U.S. PATENT DOCUMENTS

| | | | |
|---|---|---|---|
| 2,159,654 | 5/1939 | Catlin | 606/240 |
| 4,411,424 | 10/1983 | Barnett . | |
| 4,462,252 | 7/1984 | Smidt et al. . | |
| 4,474,370 | 10/1984 | Oman . | |
| 4,500,089 | 2/1985 | Jones . | |
| 4,541,628 | 9/1985 | Parviainen . | |
| 4,621,809 | 11/1986 | Pearl . | |
| 4,623,144 | 11/1986 | Rockwell | 482/100 |
| 4,666,152 | 5/1987 | Jones . | |
| 4,686,968 | 8/1987 | Scherger | 606/237 |
| 4,702,108 | 10/1987 | Amundsen et al. . | |
| 4,729,561 | 3/1988 | Desjardins . | |
| 4,732,380 | 3/1988 | Maag . | |
| 4,732,381 | 3/1988 | Skowronski . | |
| 4,802,462 | 2/1989 | Reiss et al. . | |
| 4,836,536 | 6/1989 | Jones . | |
| 4,893,808 | 1/1990 | McIntyre et al. . | |
| 4,902,009 | 2/1990 | Jones . | |
| 5,004,230 | 4/1991 | Jones . | |
| 5,007,634 | 4/1991 | Jones . | |
| 5,070,863 | 12/1991 | McArthur et al. . | |
| 5,474,513 | 12/1995 | Carlesimo et al. | 482/142 |
| 5,496,247 | 3/1996 | Anderson | 482/142 |

FOREIGN PATENT DOCUMENTS

| | | |
|---|---|---|
| 295804 | 12/1988 | European Pat. Off. . |
| 3632124 | 7/1988 | Germany . |

*Primary Examiner*—Richard J. Apley
*Assistant Examiner*—Victor K. Hwang
*Attorney, Agent, or Firm*—Kane, Dalsimer, Sullivan, Kurucz, Levy, Eisele, and Richard, LLP

[57] ABSTRACT

The spine rehabilitation apparatus includes a frame having a vertical part and an inclined part; a counterforce device on the vertical part of the frame has an operating linkage having a pivot axle, and a support adapted to rest against the upper body region of the user of the rehabilitation apparatus, and the operating linkage is rotatable about the pivot axle; a seat part is on the inclined part of the frame, and below the pivot axle and the support, and is adjustably positioned on the inclined part of the frame; a convex member having a substantially cylindrical surface is affixed to the inclined part of the frame above the seat part forming with the seat part a wedge mechanism; a lever-lock mechanism for securing a user's pelvis to the wedge mechanism by holding the knees of the user in a fixed position is attached to and extends from the frame beneath the seat part and includes a foot rest and a supporting structure for securing a user's pelvis with a pressure applied to the user's knees, substantially parallel to the user's thighs and acting through the thighs on the pelvis, so that the pelvis of the user may be immobilized between the seat part and the convex member when the seat part is adjusted on the inclined part of the frame to a position wherein the convex member coincides with the pelvis and the lowest lumbar vertebra of the user, the convex member curving in its height direction and providing a substantially cylindrical surface on the inclined part of the frame for controlling the extension of a user's spine thereagainst and thereabout, so that the muscles along the spine of a user may be exercised sequentially.

11 Claims, 2 Drawing Sheets

SPINE REHABILITATION APPARATUS

CROSS-REFERENCE TO RELATED APPLICATIONS

This is a continuation-in-part of application Ser. No. 08/053,530, filed on Apr. 27, 1993 and now abandoned, which is a continuation of application Ser. No. 07/792,021, filed on Nov. 13, 1991 and now abandoned, which is a continuation-in-part of application Ser. No. 07/476,160, filed on Feb. 7, 1990 and now abandoned.

BACKGROUND OF THE INVENTION

1. Field of the Invention

The present invention concerns an apparatus for rehabilitation of the spine musculature.

2. Description of the Prior Art

Various spine and back rehabilitation means are known in the art in which the user, supporting himself on a bench in substantially sitting position extends his back backwards while a suitable counterforce means leans e.g. on the shoulder region of the user and counteracts this motion. The user is fixed to the bench with a hip belt resembling the safety belt used in aircraft, by which the pelvis is meant to be held stationary during said motion. In the exercise motion, the back is extended freely in a manner which the user experiences as comfortable, and in suitable amount.

The drawback of existing apparatus is however that people are not accustomed to use their spine and back musculatures dynamically and therefore do not know how to use, in existing means, their musculature in a coordinated way when extending their spine: movement is mainly at the hip joint by action of the large muscles of thighs and buttocks in such exercising means, and the back and other musculatures proper which should be exercised goes nearly unused. This problem is in part due to the fact that in existing means the pelvis cannot be adequately immobilized: it is able to rotate and turn during the back movements, and hereby it becomes possible for the user to use his largest muscles, that is the thigh and buttock muscles in connection with the motion. Due to the free movement of the spine in existing means it is also impossible to control adequately the movement of the vertebrae of the spine. This control is invaluable for rehabilitation purposes, as most back problems are local in nature requiring carefully targeted mobilization.

Owing to the use of the above-mentioned muscles of the buttocks and thighs and an uncoordinated use of spine musculature there is a risk that exercising of the back takes place with wrong movements, causing excessive torsions and compressions in the regions of certain vertebrae, which may result e.g. in slipped intervertebral disks.

SUMMARY OF THE INVENTION

The object of the invention is to eliminate the drawbacks mentioned. It is particularly an object of the invention to provide a novel spine and back rehabilitation apparatus, by the aid of which the user is forced to use his spine and back musculature in a coordinated rehabilitation motion, this being achieved by preventing the action of other muscles and joints and by delimiting and controlling the motion of the spine to be appropriate for all of its muscles.

The spine rehabilitation apparatus of the invention comprises a frame, said frame having a vertical part and an inclined part; a counterforce device on said vertical part of said frame, said counterforce device being provided with an operating linkage having a pivot axle, said operating linkage having a support adapted to rest against the upper body region of the user of said rehabilitation apparatus, said operating linkage being rotatable about said pivot axle; a seat part on said inclined part of said frame, said seat part being below said pivot axle and said support, said seat part further being adjustably positioned on said inclined part of said frame; a convex member having a substantially cylindrical surface, said convex member being affixed to said inclined part of said frame above said seat part forming with said seat part a wedge mechanism; and a lever-lock mechanism for securing a user's pelvis to said wedge mechanism by holding the knees of said user in a fixed position, said lever-lock mechanism being attached to and extending from said frame beneath said seat part, said lever-lock mechanism including a foot rest and a supporting structure for securing a user's pelvis with a pressure applied to the user's knees, substantially parallelling the user's thighs and acting through the thighs on the pelvis, so that the pelvis of the user may be immobilized between said seat part and said convex member when said seat part is adjusted on said inclined part of said frame to a position wherein said convex member coincides with the pelvis and the lowest lumbar vertebra of the user, said convex member curving in its height direction and providing a substantially cylindrical surface on said inclined part of said frame for controlling the extension of a user's spine thereagainst and thereabout, so that the muscles along the spine of a user may be exercised sequentially.

In this way is accomplished securing and pressing of the pelvis in between the seat part and the convex surface so that when the back is extended against the convex surface, the pelvis will be held perfectly stationary, torsions of the pelvis with the aid of the buttock and thigh muscles will be prevented and extension of the spine will be controlled in a coordinated way by limiting the movement of each vertebra in succession starting from the lowest lumbar vertebra in order up to the upper thoracal vertebrae, thus requiring the emphasized movement and mobilization of each successive vertebra in relation to the previous vertebra controlled by the convex surface.

Advantageously, the spine rehabilitation means of the invention comprises an adjustment by the aid of which the distance between the convex surface and the seat part can be regulated to match the size of the user. The adjustment may be either by regulating the location of the seat part relative to the convex surface or by regulating the location of the convex surface relative to the seat part.

Advantageously, the supporting structure of the invention consists of an arm resting against the frame of the means and of knee rests disposed to rest against said arm and a foot rest extending forward from the frame below the seat part, by the aid of which the knees can be urged in desired direction. In an advantageous embodiment, the arm is pivotally attached to the frame under the seat part of the apparatus and, in addition, the knee rest is adjustable on the arm at different lengths, whereby the knee rest is closely adjustable to match the user's size. In an advantageous embodiment said foot rest is adjustable at different heights, whereby the angle of the thighs is adjustable to enable a proper angle of force on the pelvis to secure it between the seat part and convex surface.

In an advantageous embodiment said operating linkage comprises a support pad and said support pad rests against the chest and neck region of the user of said apparatus. In this way the muscles along the upper body of a user in the abdominal region may be exercised sequentially from up to down with selectable load as the chest and neck region of the user pushes forwards against said support pad and the user straightens his upper body from around said convex member.

The operating linkage of the spine rehabilitation apparatus is advantageously arranged to apply its action in the user's shoulder region, and in an advantageous embodiment of the invention in the operating linkage has been provided a rotatably carried, preferably padded, cylindrical support roll which, when the means is being used, rests against the user's shoulder region and, rolling lightly in the shoulder region and parallel to the spinal column, enables a light movement which does not chafe the shoulders.

In an advantageous embodiment of the invention, the convex surface consists of a round-shaped part of a cylinder shell with radius of curvature in the range of 10 to 30 cm, advantageously 15 to 25 cm. The shape of a cylinder has been found to have the correct shape within sufficient accuracy, so that on extending the spine the correct, and adequate, movements of the vertebrae are obtained. The advantage of a round-shaped structure like this is its simplicity and, consequently, favourable manufacturing.

In another embodiment of the invention, the convex surface has been formed of a surface with variable curvature so that the radius of curvature of the surface is consistent with the natural curvature of a human back extended backward into or close to the extreme range.

In an embodiment of the invention, the pivot axle of the operating linkage of the apparatus resting against the frame, which is horizontal and disposed above the seat part, has been placed substantially on the height of the user's lumbar vertebrae. The advantageous height has been found to be that of the region of the user's third lumbar vertebra, in which case the transversal support roll of the operating linkage, or equivalent, extending substantially from one side to the other of the apparatus and acting against the user's shoulder region, will perform the least movement on the skin surface of the user and it may be then positioned with maximum accuracy at the most favourable point against the user, implied by the exercise situation. This adjustment is easily accomplished e.g. by adjusting the height of the seat part relative to the linkage and to the convex surface.

The advantage over the state of art gained with the present invention is that with the present apparatus the user's pelvis can be secured to be stationary along with simultaneous control of the movement of successive vertebrae and when the back is extended against the counterforce means, the dynamic action of the user's thigh and buttock muscles and uncontrolled movements of spinal vertebrae can be completely prevented, thereby achieving that the back extending motion takes place using the back musculature exclusively, including the important small intervertebral muscles, which stabilize and coordinate the vertebrae to each other during work.

Also according to this invention the muscles along the upper body of a user in the abdominal region may be exercised sequentially from up to down with selectable load as the chest and neck region of the user pushes forwards against said support pad and the user straightens his upper body from around said convex member while holding the pelvis stationary to prevent action of the hipflexor muscles.

In this way, with the aid of the wedge mechanism and lever-lock mechanism, one prevents movements of the pelvis and the dangerous torques and compressions resulting therefrom, enabling the isolated extension of the lumbar and thoracic to be uniformly distributed over its entire length.

BRIEF DESCRIPTION OF THE DRAWINGS

The invention is described in detail in the following, referring to the attached drawing, wherein.

DESCRIPTION F THE PREFERRED EMBODIMENTS

Figure 1:
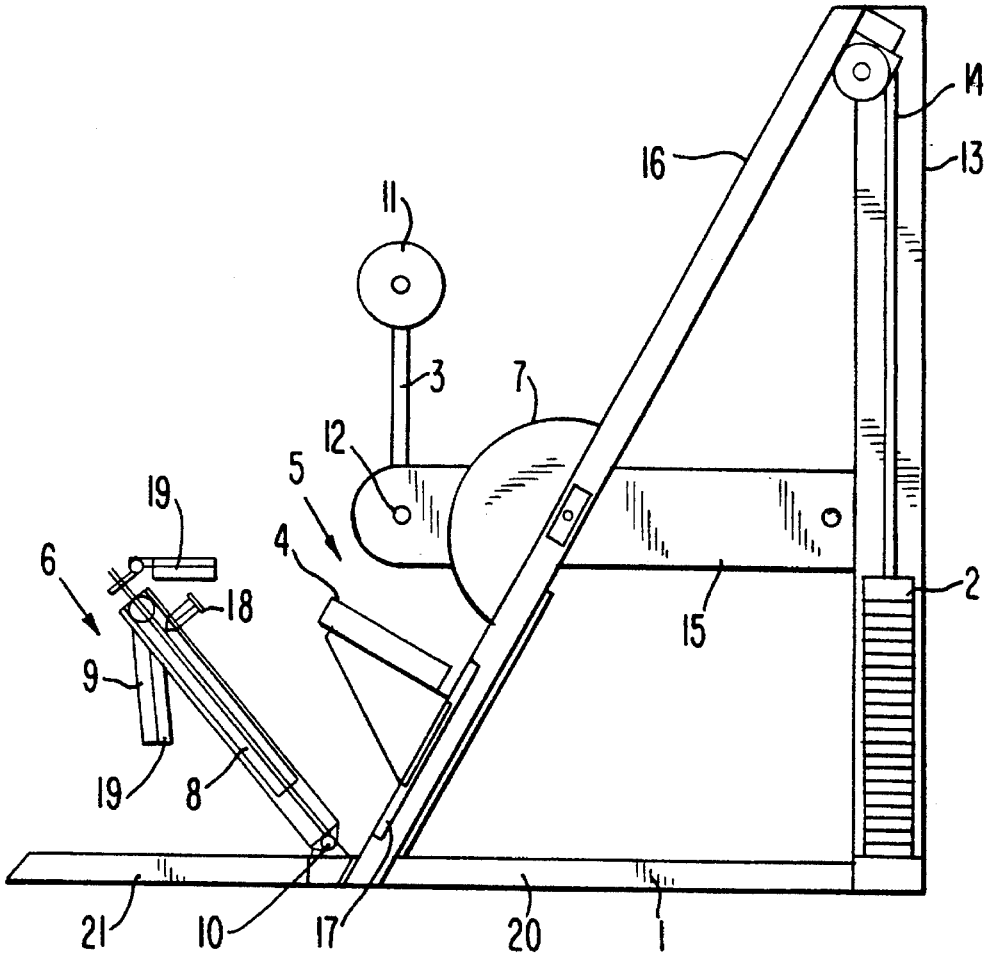
FIG. 1 presents schematically and partly sectioned a spine rehabilitation apparatus according to the invention.

The spine rehabilitation apparatus in FIG. 1 comprises a frame 1, triangular as seen from one side, on its vertical portion 13 being disposed a disk stack serving as counterforce means 2. The counterforce means connects, over force transmission belts 14 and horizontal housings 15 on either side of the frame, with the operating linkage 3 pivoted about pivot axle 12 on the ends of said housings 15. The arms of the operating linkage, projecting from the pivot points from both housings, are interconnected at their other ends by a support roll 11, which constitutes a transversal and horizontal support extending over the breadth of the means.

On the inclined part 16 of the frame 1, in the region of the housings 15 and between them, has been provided a convex surface 7, a horizontally substantially straight and level, in vertical direction curving part of a cylinder shell. Below the convex surface on the inclined part 16 has been mounted a seat part 4, which is adjustable in height with the aid of an adjusting means 17. This convex member 7 with said seat part 4 forms a wedge mechanism 5.

To the lower part of the frame 1, under the seat 4, has with a pivot 10 been attached an elongated arm 8, to which has been attached with the aid of an adjustment member 18, a knee rest 9 provided with padding 19. The adjustment member 18 enables the knee rest to be fixed at various lengths on the arm 8. This lever-lock mechanism 6 further comprises, as an extension of the lower frame part 20, a foot rest 21 extending forward and upon which the feet will rest when the user is sitting on the seat 4.

Figure 2:
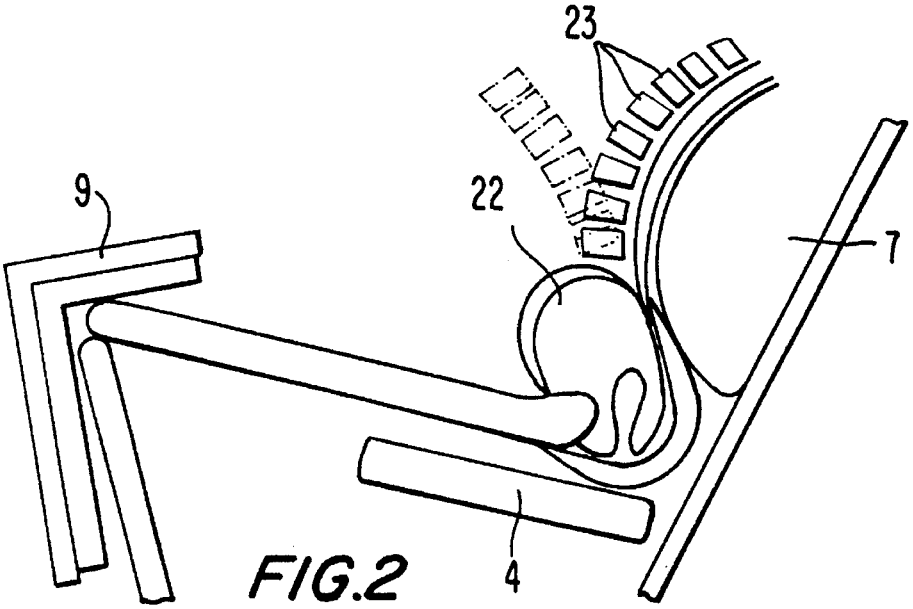
FIG. 2 shows the operating principle of the invention and FIG. 3 shows another apparatus according to the invention.

The apparatus depicted in FIG. 1, which is one of the embodiments of the invention, is used as follows, referring also to FIG. 2. The user seats himself on the seat 4, and the height of the seat is adjusted with the adjustment means 17 so that the user's hip region is positioned between the seat part 4 and the convex surface 7, into the wedge mechanism. Next, by raising the arm 8 and adjusting the knee rest 9 with the adjustment means 18, the padding 19 of the knee rest is positioned in front of, and over, the user's both knees, and the feet on the foot rest are pushed forward, which raises the knees upwards causing a backward tilt of the arm 8 around the pivot 10, so that the padding 19 of the knee rest presses on the knees, and over the knees on the thighs and substantially parallel to the thighs urges the pelvis in between the seat part and the convex surface. In this manner, the user's pelvis 22 is immobilized or wedged non-rotatably in between the seat part and the convex surface. With the user placed on the bench in this manner, on backward extending the spine will press against and bend around the convex surface 7, while the user's shoulder region rests against the support roll 11, by means of which a counterforce opposing the motion is obtained. Since the user's pelvis is positioned in the recess between the convex surface 7 and the seat part 4, while the spinal column bends along and against the convex surface, the vertebrae alone can move one by one and be extended relative to each other. For this reason, motions of the pelvis are completely inhibited, and hereby is also prevented any dynamic use of the lumbar and buttock musculature, and extending of the back is controlled by the convex surface and movement takes place exclusively with the coordinated aid of the comprehensive back musculature.

It is also an essential feature of the invention that during exercise motion and while the pelvis is stationary, the vertebrae 23 will one at a time, in succession upwards from below, come to press against the convex surface 7 and remain stationary thereafter. In the course of one exercise movement all the muscles on the whole length of the back including the small muscles controlling the vertebral movements will be used, not only certain largest muscles, as is the case in existing devices. In this manner the motion fulcrum moves along the convex surface in the course of movement.

Figure 3:
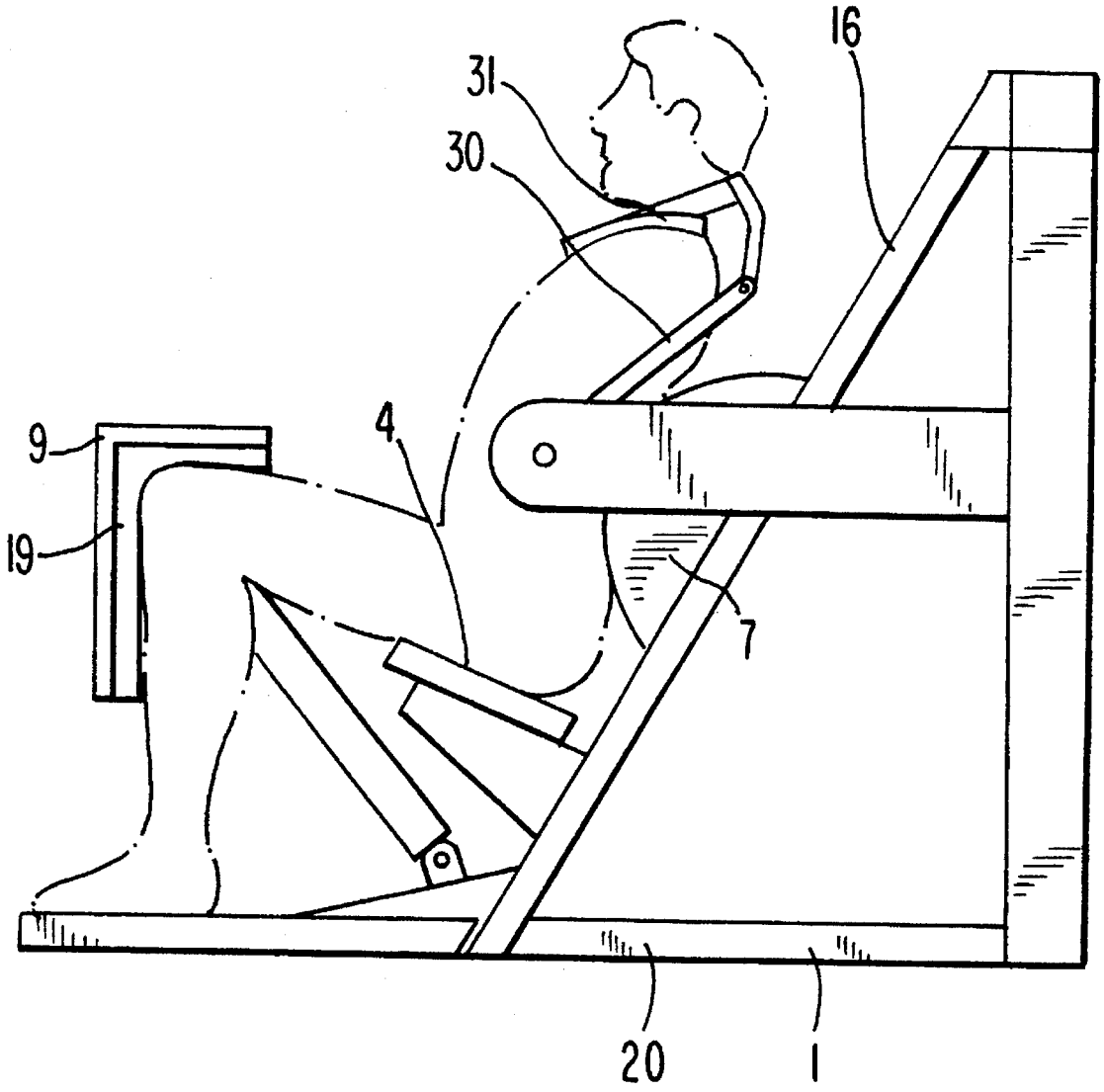

In FIG. 3 the apparatus is almost similar to the apparatus of FIG. 1. The only difference is an operating linkage 30, which comprises a support pad 31 fitted to be rested against the chest and neck region of the user of said apparatus. In this way the muscles along the upper body of a user in the abdominal region may be exercised sequentially from up to down with selectable load as the chest and neck region of the user pushes forwards against the support pad 31 and straightens his upper body from around the convex surface 7.

What is claimed is:

1. Spine rehabilitation apparatus comprising:

a frame, said frame having a vertical part and an inclined part;

a counterforce device on said vertical part of said frame, said counterforce device being provided with an operating linkage having a pivot axle, said operating linkage having a support adapted to rest against the upper body region of the user of said rehabilitation apparatus, said operating linkage being rotatable about said pivot axle;

a seat part on said inclined part of said frame, said seat part being below said pivot axle and said support;

a convex member having a substantially cylindrical surface, said convex member being affixed to said inclined part of said frame above said seat part forming with said seat part a wedge mechanism;

a lever-lock mechanism, said lever-lock mechanism being attached to and extending from said frame beneath said seat part, said lever-lock mechanism including a foot rest and a supporting structure, said support structure extending upward from said frame to a position in front of said seat part, and said convex member curving in its height direction and providing a substantially cylindrical surface on said inclined part of said frame.

2. Spine rehabilitation apparatus according to claim 1, further comprising an adjustment means for adjusting said seat part on said inclined part of said frame.

3. Spine rehabilitation apparatus according to claim 1, wherein said supporting structure comprises an arm, said arm having a first end and a second end, said first end being attached to and carried on the frame and a knee rest being carried on said second end of said arm.

4. Spine rehabilitation apparatus according to claim 3, wherein said first end of said arm is attached to said frame with a pivot for adjusting the distance between said knee rest and said wedge mechanism.

5. Spine rehabilitation apparatus according to claim 3, wherein said knee rest includes an angular rest member.

6. Spine rehabilitation apparatus according to claim 1, wherein said foot rest forms an extension from the frame below said seat part and said supporting structure.

7. Spine rehabilitation apparatus according to claim 1, wherein said support is a cylindrical support roll, said cylindrical support roll being rotatably carried on said operating linkage.

8. Spine rehabilitation apparatus according to claim 1, wherein said support is a support pad.

9. Spine rehabilitation apparatus according to claim 1, wherein said convex member has a cylindrical surface with a radius of curvature in the range of 10 to 30 cm.

10. Spine rehabilitation apparatus according to claim 1, wherein said convex member has a surface with variable curvature.

11. Spine rehabilitation apparatus according to claim 1, wherein said pivot axle of the operating linkage has been placed on the frame above the seat part.

* * * * *